United States Patent [19]

Heys, Jr. et al.

[11] Patent Number: 4,857,712

[45] Date of Patent: Aug. 15, 1989

[54] SLIP TABLE WITH INTEGRATED SLIP GUIDE

[75] Inventors: George Heys, Jr., Cambridge; David M. J. Allgeier, Cumberland, both of Ohio

[73] Assignee: NCR Corporation, Dayton, Ohio

[21] Appl. No.: 273,293

[22] Filed: Nov. 18, 1988

[51] Int. Cl.[4] ..... G06C 29/00

[52] U.S. Cl. ..... 235/58 P; 235/4; 235/58 CF

[58] Field of Search ..... 235/2-5, 235/58 CF, 58 CW, 58 P, 60 P, 484

[56] References Cited

U.S. PATENT DOCUMENTS

| | | | |
|---|---|---|---|
| 409,340 | 8/1889 | Unz | 281/44 |
| 2,436,273 | 2/1948 | Solomon | 273/139 |
| 3,061,969 | 11/1962 | Lunday | 248/448 |
| 4,386,265 | 5/1983 | Sugimori | 235/3 |
| 4,458,874 | 7/1984 | Rabas et al. | 248/670 |
| 4,742,771 | 5/1988 | Heilig | 101/407 |

*Primary Examiner*—B. R. Fuller

*Attorney, Agent, or Firm*—Wilbert Hawk, Jr.; Albert L. Sessler, Jr.; Elmer Wargo

[57] ABSTRACT

An integrated slip guide member and slip table assembly for use with business machines. The slip table has a first and second groups of parallel grooves thereon which are spaced apart in parallel relationship. The slip guide member has first and second members which receive the a portion of the slip table to enable the guide member to be moveable on the slip table to accommodate different widths of documents. The slip guide member also has detent members thereon to mesh with the first and second groups of parallel grooves to adjustably secure the slip guide member on the slip table.

12 Claims, 3 Drawing Sheets

SLIP TABLE WITH INTEGRATED SLIP GUIDE

BACKGROUND OF THE INVENTION (1) Field of the Invention

This invention relates to a slip table with an integrated slip guide for use with accounting machines and the like.

(2) Description of the related art

In the process of utilizing accounting machines, like the ones used in department stores, for example, a point is reached during the processing of a transaction when a sales clerk inserts a document, such as a sales slip, into such a machine to have the transaction recorded upon the sales slip. The sales slip is positioned and aligned on a slip table associated with the machine so that the sales slip can be printed upon by a printer in the machine. The sales slip may be drawn into the machine to have several entries (reflecting several purchases) of transaction data printed upon it, with the sales clerk entering data about several purchases on a keyboard, for example. Upon completion of the data entering and printing operations, the sales slip is moved out of the machine, and it is grasped by the sales clerk to complete the transaction with the customer.

One of the problems associated with the activities described in the previous paragraph is that as a sales slip is drawn into the machine, it tends to become skewed, causing the printing to be skewed.

Another problem is that, for those machines which used guides for guiding the sales slip into the printer of the machine, it was difficult to adjust the guides to accommodate different widths of documents used by different department stores, for example. At times, different widths of documents have to be handled by the same department store.

SUMMARY OF THE INVENTION

In contrast with the above, the present invention provides a quick way of adjusting a slip guide on a slip table to accommodate different widths of documents.

Another advantage of the present invention is that it is easy to manufacture and install in a machine.

Another advantage is that special tools are not required to adjust the slip guide to accommodate different widths of documents.

In one aspect of a preferred embodiment of the invention, there is provided an assembly for use in positioning a document relative to a print station, comprising:

a generally planar table having positioning means to enable said assembly to be positioned in operative relationship with said print station when said assembly is used in conjunction with said print station; and a guide member which is adjustably fixed on said planar table;

said planar table having a first side portion having a fixed guide thereon, a second side portion to receive said guide member, and a third side portion positioned between said first and second side portions to function as at least a document entry side of said assembly;

said second side portion having a first plurality of parallel grooves therein and a second plurality of parallel grooves therein, with said second plurality of grooves being spaced from and parallel to said first plurality of grooves; and said guide member having securing means coacting with said first and second pluralities of grooves for adjustably securing said guide member to said second portion to enable said fixed guide and said guide member to guide a document positioned therebetween to said print station.

In another aspect of a preferred embodiment of the invention, there is provided an accounting machine comprising:

a printer;

said accounting machine having a slot therein to enable a document to be printed upon to be inserted in said slot;

control means for controlling the operation of said accounting machine and said printer;

a generally planar table having positioning means to enable said planar table to be positioned in said accounting machine in inoperative relationship with said printer and said slot; and a guide member which is adjustably fixed on said planar table;

said planar table having a first side portion having a fixed guide thereon, a second side portion to receive said guide member, and a third side portion positioned between said first and second side portions to function as at least a document entry side of said planar table;

said second side portion having a first plurality of parallel grooves therein and a second plurality of parallel grooves therein, with said second plurality of grooves being spaced from and parallel to said first plurality of grooves; and said guide member having securing means coacting with said first and second pluralities of grooves for adjustably securing said guide member to said second portion to enable said fixed guide and said guide member to guide a document positioned therebetween to said printer.

The above advantages and others will be more readily understood in connection with the following specification, claims and drawings.

DESCRIPTION OF THE PREFERRED EMBODIMENT

Figure 1:
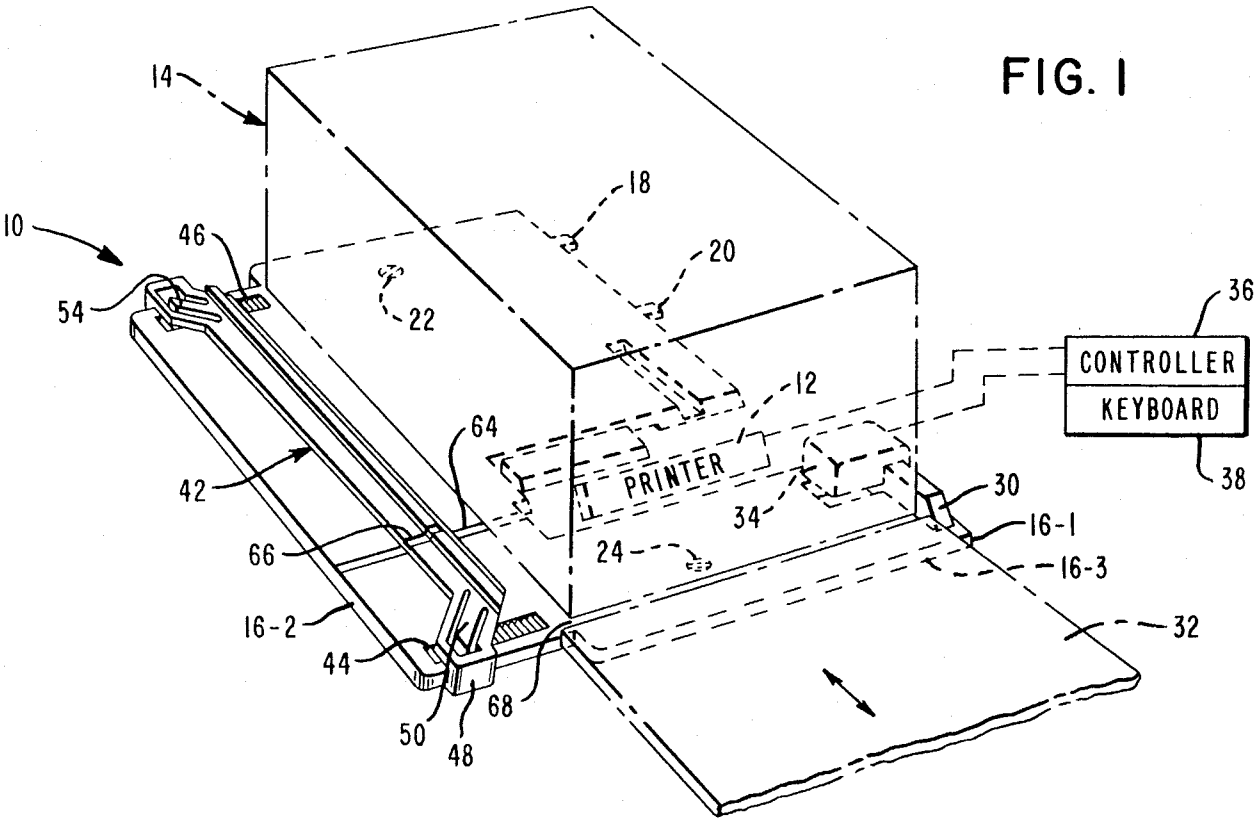
FIG. 1 is a general perspective view, showing a business machine in which the assembly made according to this invention may be installed, and also showing a document to be inserted in the machine for printing.
Figure 2:
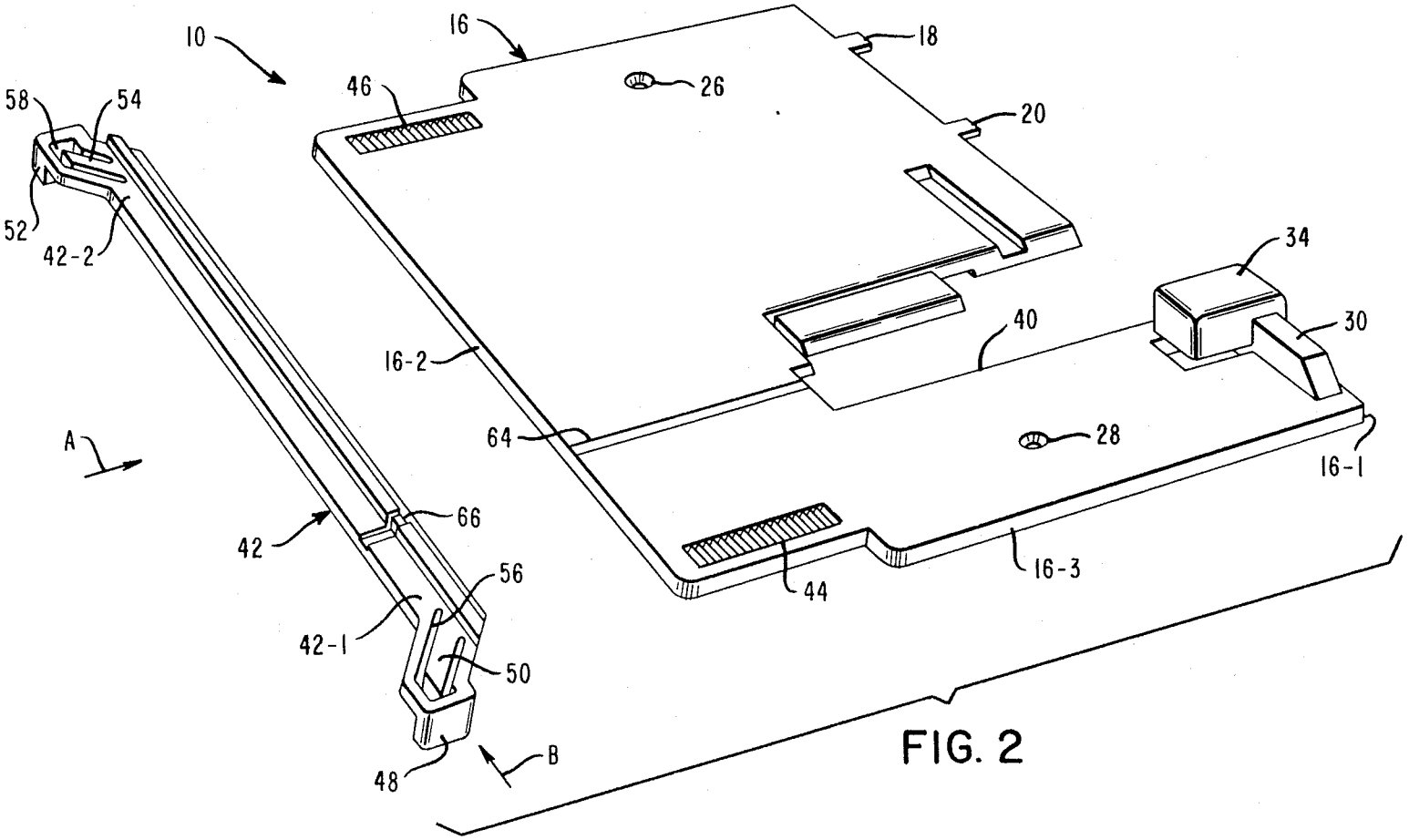
FIG. 2 is an enlarged, exploded view, in perspective, of the assembly shown in FIG. 1 to show additional details of the slip table and the moveable guide shown in FIG. 1.

FIG. 2 is an exploded view, in perspective, of a preferred embodiment of this invention, which shows an assembly 10 for positioning a document relative to a print station or printer 12 included in a business machine, like a cash register or the accounting machine 14 shown in FIG. 1. The machine 14 is shown only schematically in FIG. 1.

The assembly 10 includes a generally planar slip table or table 16 which has means for positioning the assembly 10 in operative relationship with the printer 12. The positioning means include the projections, like 18 and 20, which extend from the table 16 to fit into complementary recesses (not shown) in the machine 14 and also include the fasteners 22 and 24 (FIG. 1) which pass through holes 26 and 28 (FIG. 2) included in the table 16. By this construction, the assembly 10 can be quickly installed in the machine 14.

The table 16 (FIG. 2) also has a first side portion 16-1, a second side portion 16-2, and a third side portion 16-3 which is located between the first and second side portions 16-1 and 16-2, respectively. The first side portion 16-1 has a fixed guide 30 upstanding therefrom to form a guide for the right side of the document 32, as viewed in FIG. 1. A document sensor 34, also located on the first side portion 16-1, is used to let the controller 36 know when a document 32 is positioned in operative relation with the printer 12. The controller 36 is conventional, and it has a keyboard 38, for entering sales data in the machine 14, for example. The table 16 also has a cut out area 40 to receive the conventional printer 12 shown only schematically in FIG. 1.

The second side portion 16-2 of the table 16 extends partially out of the machine 14 and receives the guide member designated generally as 42. The guide member 42 is adjustably positioned on the table 16 to provide a variable guide for documents of different widths to be inserted in the machine 14. The second side portion 16-2 has a first plurality 44 of parallel grooves formed on the surface of the table 16, and it also has a second plurality 46 of such grooves. The first and second pluralities 44 and 46 of grooves are spaced apart in parallel relationship as shown in FIG. 2.

The guide member 42 is adjustably fixed or secured to the table 16 by cooperating with the first and second pluralities 44 and 46 of grooves. In this regard, the guide member 42 has securing means for adjustably securing the guide member 42 to the table 16. The securing means includes a first member 48 and a second member 50 located at the first end 42-1 of the guide member 42, and correspondingly, the securing means includes a third member 52 and a fourth member 54 located at the second end of the guide member 42.

Figure 3:
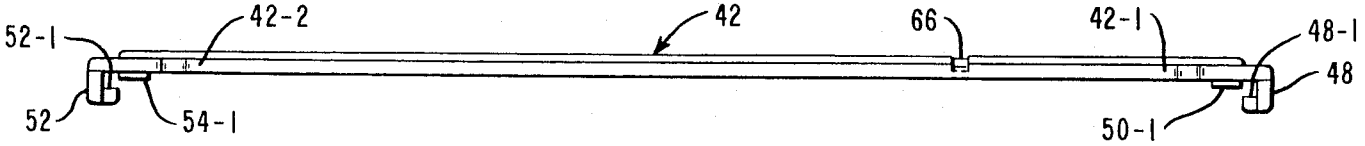
FIG. 3 is an end view, in elevation, which is taken from the direction of arrow A in FIG. 2 to show additional details of the moveable guide.

The first and third members 48 and 52 of the guide member 42 are generally "C"-shaped, as shown best in FIG. 3, to provide the slots 48-1 and 52-1, respectively. When the guide member 42 is mounted on the table 16, the second side portion 16-2 of the table 16 is received within the slots 48-1 and 52-1 as shown in FIG. 1.

The first end 42-1 of the guide member 42 has a portion removed therefrom as at area 56 (FIG. 2) to define the second member 50 as finger or a cantilever-type member. The lower side of the second member 50 has an elongated detent 50-1 depending therefrom as shown in FIG. 3. The detent member 50-1 is positioned in one of the grooves of the first plurality 44 of grooves to adjustably position the guide member 42 on the table 16. When the guide member 42 is mounted on the table 16, the second member 50 resiliently biases the detent member 50-1 into the grooves of the first plurality 44 of grooves which function as ratchet grooves.

Correspondingly, the second end 42-2 of the guide member 42 has a portion removed therefrom as at area 58 (FIG. 2) to define the fourth member 54 as a finger or a cantilever-type member. The lower side of the fourth member 54 has an elongated detent member 54-1 depending therefrom as shown in FIG. 3. The detent member 54-1 is positioned in one of the grooves of the second plurality 46 of grooves to adjustably position the guide member 42 on the table 16.

Figure 4:
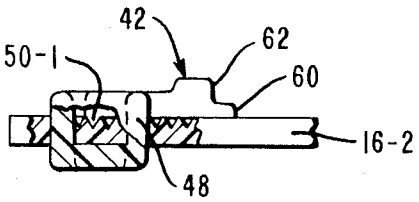
FIG. 4 is an end view of the moveable guide, and it is taken along the direction of arrow B shown in FIG. 2.

The guide member 42 has a lip portion 60 (FIG. 4) extending along the length thereof to contact the table 16 when the guide member 42 is positioned on the table 16. The function of the lip portion 60 is to direct a document 32 into the shoulder 62 of the guide member 42 as it is moved towards the printer 12 in the machine 14. The shoulder 62 and the fixed guide 30 keep a document from skewing as the document 32 is moved towards the printer 12.

In the embodiment described, the guide member 42 is made of a plastic material like polycarbonate, although other comparable plastic materials could be used. The first, second, third, and fourth members 48, 50, 52, and 54 of the guide member 42 are integrally formed with the guide member 42. The table may also be made of polycarbonate.

One of the features of this invention is that it is simple to install in the machine 14 as previously described. Another feature is that it is easy to change the location of the guide member 42 so that different widths of documents can be accommodated between the guide member 42 itself and the fixed guide 30. To change the location, an operator simply pushes or pulls the guide member 42 to cause the detents 48-1 and 54-1 to move out f their associated grooves in the first and second pluralities 44 and 46 of grooves into other grooves. The second and fourth members 50 and 54 are resilient enough to permit the detenting just described to take place. The table 16 also has a slight groove 64 therein to indicate to the operator where the print line associated with the printer 12 is located. The guide member 42 also has a groove 66 therein to indicate the print line.

To use the assembly 10, the operator simply inserts a document 32 into the machine 14 by moving the right edge of the document 32 against the fixed stop 30. A slot 68 exists between the machine 14 and the table 16 to receive the document 32. If the guide member 42 is not adjusted to the width of the document 32, it can be moved towards or away from the left end of the document 32 as viewed in FIG. 1. When the machine 14 is actuated for printing, the document 32 is pulled into the machine to effect one or more lines of printing. Thereafter, the document 32 is moved out of the machine 14. The moveable guide 42 would not need adjusting until a new form or document had to be introduced into the machine. Naturally, the moveable guide 42 should be kept parallel to the fixed guide 30 when it is adjusted to the width of a particular document to be inserted in the machine 14.

What is claimed is:

1. An assembly for use in positioning a document relative to a print station, comprising:

a generally planar table having positioning means to enable said assembly to be positioned in operative relationship with said print station when said assembly is used in conjunction with said print station; and a guide member which is adjustably fixed on said planar table;

said planar table having a first side portion having a fixed guide thereon, a second side portion to receive said guide member, and a third side portion positioned between said first and second side portions to function as at least a document entry side of said assembly;

said second side portion having a first plurality of parallel grooves therein and a second plurality of parallel grooves therein, with said second plurality of grooves being spaced from and parallel to said first plurality of grooves; and said guide member having securing means coacting with said first and second pluralities of grooves for adjustably securing said guide member to said second portion to enable said fixed guide and said guide member to guide a document positioned therebetween to said print station.

2. The assembly as claimed in claim 1 in which said guide member has first and second ends and in which said securing means includes first and second members at said first end and also includes third and fourth members at said second end;

each of said first and third members having a slot therein to receive said second side portion of said planar table; and each of said second and fourth members having a detent member thereon, with said detent members of said second and fourth members engaging, respectively, said first and second pluralities of parallel grooves.

3. The assembly as claimed in claim 2 in which said first, second, third, and fourth members are integrally formed on said guide member.

4. The assembly as claimed in claim 3 in which said guide member has a length with a shoulder extending along said length, said guide member also having a lip extending along said length to guide said document into abutment with said shoulder as said document is moved to said print station.

5. The assembly as claimed in claim 4 in which said first end has a portion removed therefrom to define said second member as a finger, and in which said second end has a portion removed therefrom to define said fourth member as a finger.

6. The assembly as claimed in claim 5 in which said guide member is made of a plastic material like polycarbonate, and in which said detent members of said second and fourth members are elongated in shape and are aligned to be received, respectively, in said first and second pluralities of parallel grooves.

7. An accounting machine comprising:

a printer;

said accounting machine having a slot therein to enable a document to be printed upon to be inserted in said slot;

control means for controlling operation of said accounting machine and said printer;

a generally planar table having positioning means to enable said planar table to be positioned in said accounting machine in inoperative relationship with said printer and said slot; and a guide member which is adjustably fixed on said planar table;

said planar table having a first side portion having a fixed guide thereon, a second side portion to receive said guide member, and a third side portion positioned between said first and second side portions to function as at least a document entry side of said planar table;

said second side portion having a first plurality of parallel grooves therein and a second plurality of parallel grooves therein, with said second plurality of grooves being spaced from and parallel to said first plurality of grooves; and said guide member having securing means coacting with said first and second pluralities of grooves for adjustably securing said guide member to said second portion to enable said fixed guide and said guide member to guide a document positioned therebetween to said printer.

8. The accounting machine as claimed in claim 7 in which said guide member has first and second ends and in which said securing means includes first and second members at said first end and also includes third and fourth members at said second end;

each of said first and third members having a slot therein to receive said second side portion of said planar table; and each of said second and fourth members having a detent member thereon, with said detent members of said second and fourth members engaging, respectively, said first and second pluralities of parallel grooves.

9. The accounting machine as claimed in claim 8 in which said first, second, third, and fourth members are integrally formed on said guide member.

10. The accounting machine as claimed in claim 9 in which said guide member has a length with a shoulder extending along said length, said guide member also having a lip extending along said length to guide said document into abutment with said shoulder as said document is moved to said print station.

11. The accounting machine as claimed in claim 10 in which said first end has a portion removed therefrom to define said second member as a finger, and in which said second end has a portion removed therefrom to define said fourth member as a finger.

12. The accounting machine as claimed in claim 11 in which said guide member is made of a plastic material like polycarbonate, and in which said detent members of said second and fourth members are elongated in shape and are aligned to be received, respectively, in said first and second pluralities of parallel grooves.

* * * * *